US006180329B1

(12) United States Patent
Paris

(10) Patent No.: US 6,180,329 B1
(45) Date of Patent: Jan. 30, 2001

(54) PHOTOGRAPHIC MATERIAL FOR REDUCING DRIVE MECHANISM DUST

(75) Inventor: Christian Paris, Chatenoy le Royal (FR)

(73) Assignee: Eastman Kodak Company, Rochester, NY (US)

( * ) Notice: Under 35 U.S.C. 154(b), the term of this patent shall be extended for 0 days.

(21) Appl. No.: 09/370,761

(22) Filed: Aug. 9, 1999

(30) Foreign Application Priority Data

Sep. 9, 1998 (FR) ..... 98 11392

(51) Int. Cl.[7] ..... G03C 7/00

(52) U.S. Cl. ..... 430/504; 430/506; 430/530; 430/510; 430/934

(58) Field of Search ..... 430/504, 506, 430/530, 510, 934, 546

(56) References Cited

U.S. PATENT DOCUMENTS

| | | | | |
|---|---|---|---|---|
| 3,650,753 | | 3/1972 | Bacon . | |
| 5,262,288 | | 11/1993 | Sakanoue et al. . | |
| 5,298,369 | * | 3/1994 | Munshi et al. | 430/379 |
| 5,650,265 | | 7/1997 | Sniadoch et al. . | |
| 5,716,768 | * | 2/1998 | Maruyama et al. | 430/510 |

* cited by examiner

*Primary Examiner*—Janet Baxter
*Assistant Examiner*—Amanda C. Walke
(74) *Attorney, Agent, or Firm*—Doreen M. Wells

(57) ABSTRACT

A photographic material comprising a support coated with a silver halide image-forming emulsion layer, a non image-forming layer, and a hydrophilic colloid protective layer wherein the non image-forming layer is situated between the protective layer and the image-forming layer and comprises metallic silver in particle form.

4 Claims, 1 Drawing Sheet

PHOTOGRAPHIC MATERIAL FOR REDUCING DRIVE MECHANISM DUST

FIELD OF THE INVENTION

The present invention concerns a new photographic material that reduces the amount of dust generated when the material is conveyed. The invention also concerns the use of such material to reduce the amount of dust generated when the material is conveyed.

BACKGROUND OF THE INVENTION

Photographic material conventionally comprises a transparent reflective support that is coated with one or several image-forming layers containing silver halide photographic emulsions. From shooting to development, these materials are subject to many mechanical stresses. In particular, these mechanical stresses act on the photographic material when it is being moved, for example during exposure, development, printing or projection. Physical deterioration of the photographic material follows with partial shredding of the superficial layers of the photographic material. This partial shredding generates debris and dust which accumulate on the material itself, on any other photographic material in contact or located close by, and on the conveyor mechanism.

This problem is especially important in the cinematography industry. Motion picture films are photographic materials that are always used in movement, for example when shooting, developing, printing or projecting the film.

In cinematographic shooting, a set of scenes is filmed on a first color negative film for shooting. This negative film is cut and spliced to make up the final motion picture film that comprises a selection of scenes. This assembled negative film is then printed on positive color film, called a Master. This master, which constitutes the final motion picture film, is used to produce a copy onto intermediate negative film. This intermediate negative film is then used to print positive copies intended for projection in movie theater. These copies are obtained by exposing copy positive film using the intermediate negative film, the two films being placed one against the other and driven at speeds in the order of 50 to 100 m/min. This copying step is repeated as many times as necessary.

Consequently, a large number of copies are printed from a single intermediate negative film.

While these copies are being printed, dust and debris are generated by the wear and tear of the superficial parts of the copy positive film as they move. These dust and debris tend to accumulate mechanically or electrostatically on the intermediate film, which causes the appearance of defects on the following printed copies. In order to limit these defects, the copy printing operation has to be interrupted regularly to clean the intermediate negative film on which the dust and debris have accumulated.

The objective of the present invention is to provide copy positive photographic material that generates a low amount of dust and debris when printing copies.

SUMMARY OF THE INVENTION

The invention concerns photographic material comprising a support coated with a silver halide image-forming emulsion layer, and a protective layer with a hydrophilic colloid base, the material further comprising a non image-forming layer comprising metallic silver in particle form located between the protective layer and the set of image-forming layers.

The invention concerns a process for reducing the amount of dust generated by the photographic material when conveyed in drive mechanisms.

The invention further concerns a process for printing cinematographic copies that comprises exposing the material of the invention through a color negative film.

DETAILED DESCRIPTION OF THE INVENTION

Figure 1:
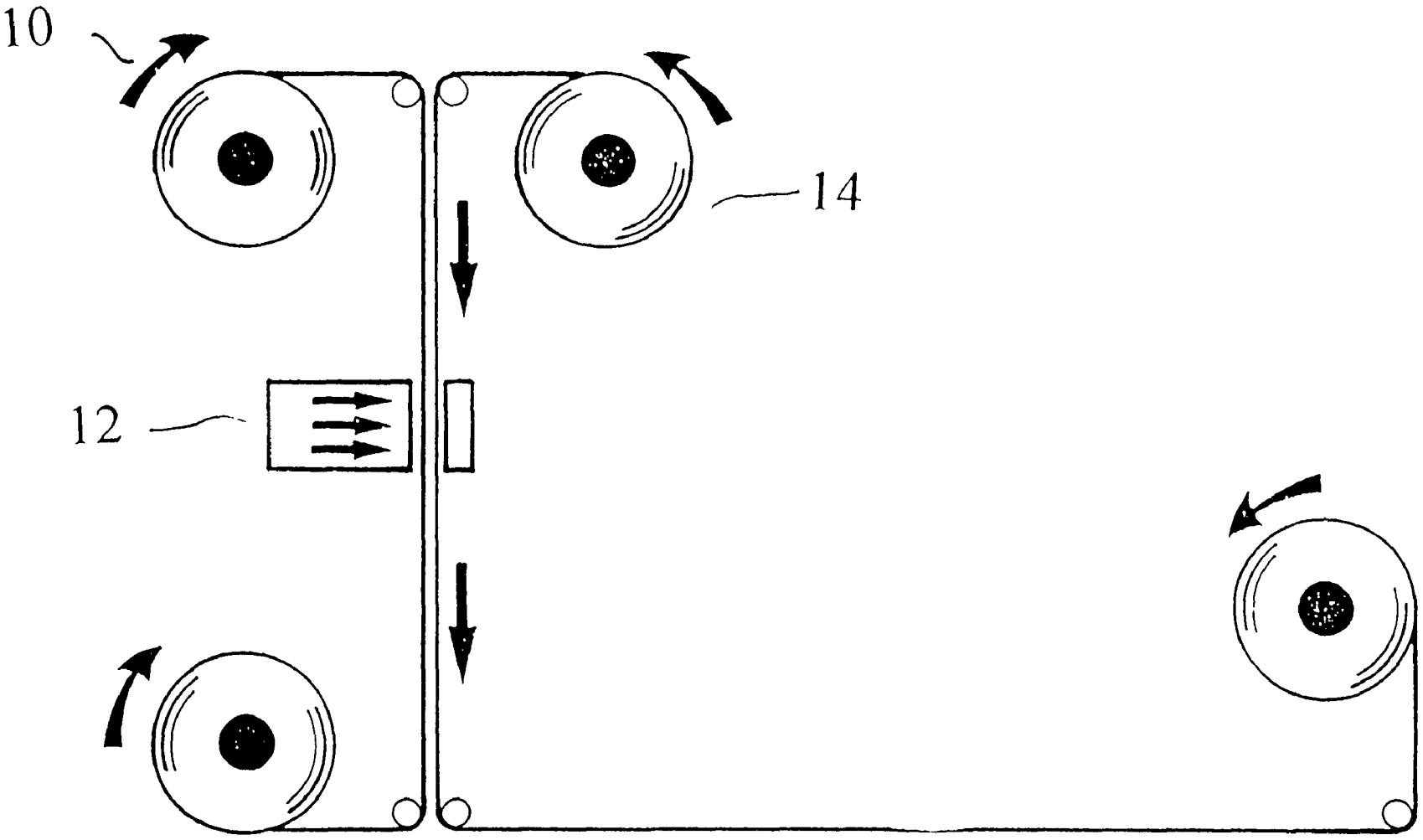
FIG. 1 represents a simplified diagram of the printing process of positive copies for projection.

The non image-forming layer of the invention material is a layer that is not sensitive to radiation, usually visible light. This layer comprises a hydrophilic colloid in which metallic silver is dispersed in particle form.

The hydrophilic colloid is usually gelatin or a gelatin derivative such as acetylated gelatin, phthalated gelatin, oxidized gelatin, etc. The hydrophilic colloid can be a water-soluble polymer or copolymer such as polyvinylic alcohol, cellulose hydroxyethyl, etc. Colloids that can be used in photography are described in *Research Disclosure*, September 1996, 591, 38957, Section II A, hereafter called "Research Disclosure".

The metallic silver particles contained in the non image-forming layer can have very varied forms, for instance balls, filaments, etc. According to one preferred embodiment, the metallic silver is in filament form. The average filament length is usually less than or equal to 0.1 $\mu$m.

According to one particular embodiment, the metallic silver content of the non image-forming layer is between 0.1 and 1 mg/dm$^2$, preferably between 0.3 and 0.6 mg/dm$^2$.

The image-forming layer of the material of the invention can comprise a set of silver halide image-forming layers.

Photographic emulsions are conventionally constituted of silver halide grains dispersed in a hydrophilic colloid, for example, gelatin. Silver halide grains can be constituted of chloride, bromide, chlorobromide, bromochloride, chloroiodide, bromoiodide or bromochloro-iodide.

The silver halide grains can have any conventional geometric form (e.g. cubic or octahedral regular crystalline form), and can be prepared using various techniques, for example, techniques such as single or double jet precipitation, with accelerated and interrupted flow, as described by T. E. James, *The Theory of the Photographic Process,* 4th ed., Macmillan, 1977, Chapter 3, and in *Research Disclosure*, Section I.

Silver halide emulsions can be sensitized chemically or by means of sensitizers based on sulfur, selenium, tellurium, platinum, gold, palladium, iridium, osmium, rhenium or phosphorus, or combinations of these sensitizers.

Silver halide emulsions can be spectrally sensitized by means of polymethine spectral dyes, which comprise the cyanines, merocyanines, cyanines and complex merocyanines (i.e. tri-, tetra- and polynuclear cyanines and merocyanines), oxonols, hemioxonols, styryls, merostyryls and streptocyanines.

Chemical or spectral sensitization methods are described in *Research Disclosure*, Sections IV and V.

Dye-forming couplers are compounds that during development produce a dye image by reacting with the oxidized developer. These compounds are known in the art and are described in detail in The Theory of the Photographic Process, 4th ed., T. E. James, 337–338 and in Research Disclosure, Section X; these compounds are for example, acylacetanilide compounds, 5-pyrazolones substituted in position 1 and 3, phenols, indophenols, etc.

In addition to the compounds mentioned above, the photographic product can contain other compounds that are photographically useful, for example, coating aids, stabilizers, plasticizers, antifoggants, antistatic agents, matting agents, oxidized developer scavengers, etc. Examples of these compounds are described in *Research Disclosure*, Sections VI, VII, VIII, and X.

Supports useful in the scope of the invention are described in Section XV of *Research Disclosure*. These supports are usually polymer supports such as cellulosic polymers, polystyrenics, polyamides, polyvinylics, polyethylene, polyester, paper or metallic supports.

According to one particular embodiment, the invention material comprises at least one additional layer located between the non image-forming layer and the set of image-forming layers, this additional layer containing an oxidized developer scavenger, for example 2,5 di-sec-hydroquinone.

The material of the invention can be a black-and-white photographic material or a color photographic material.

The invention material is preferably a color product of which the set of image-forming silver halide emulsion layers of the material of the present invention comprises at least one blue sensitive silver halide emulsion layer containing a yellow dye-forming coupler, at least one red sensitive silver halide emulsion layer containing a cyan dye-forming coupler, and at least one green sensitive silver halide emulsion layer containing a magenta dye-forming coupler.

The material of the present invention is preferably color positive motion picture film intended for printing copies for motion picture. Such material comprises a transparent support and a set of image-forming silver halide emulsion layers containing in order from the support, one emulsion layer with blue sensitive silver halides containing a yellow dye-forming coupler, one emulsion layer with red sensitive silver halides containing a cyan dye-forming coupler, and one emulsion layer with green sensitive silver halides containing a magenta dye-forming coupler.

The invention material can comprise intermediate layers, for example, an antihalation layer, an antistatic layer, and oxidized developer scavenger layers, etc. These various layers and their arrangements are described in Section XI of *Research Disclosure.*

The material of the present invention is particularly useful for printing otion picture copies. In this case, the material is exposed as shown in FIG. 1 herein the material 10 is a developed intermediate negative film, for example, ENC® film manufactured by the Eastman Kodak Company, the material 14 is a material of the present invention, the device 12 is a device for exposing the material 14 through the negative film 10, the material 14' being the invention material after exposure.

The material 14' is a motion picture copy that after development will be ready for projection.

The present invention is shown in detail in the following examples that demonstrate the advantages.

EXAMPLE 1

Control

The copy positive film is Eastman color positive ECP® 35 mm film, manufactured by Eastman Kodak, which comprises a support coated on one side with an antihalation layer, and on the other side, in order, with one emulsion layer with blue sensitive silver halides containing a yellow dye-forming coupler, an interlayer of gelatin containing an oxidized developer scavenger, one emulsion layer with red sensitive silver halides containing a cyan dye-forming coupler, a second interlayer of gelatin containing an oxidized developer scavenger, one emulsion layer with green sensitive silver halides containing a magenta dye-forming coupler, and a protective layer.

A sample of 12 meters of film was tested on a device comprising two rows of three rollers separated from one another. The ends of the sample were linked one to another to form a loop. This loop placed on the rollers was run at a speed of 430 m/min for 96 turns.

The film was removed from the test device. It was then exposed and developed with the standard process, Eastman Kodak ECP-2A®. Then the "defects" present on the 12-meter sample were counted.

This operating method was reproduced with five samples, the amount of dust given below is an average result of the dust counted on the five samples.

The results are given in Table 1 below.

EXAMPLE 2

Invention

In this example, the operating method of Example 1 was reproduced going from copy positive film to the ECP® film, as previously described, but comprising an additional layer located between the protective layer and the set of sensitive layers, this layer comprising gelatin (9.15 mg/dm ) and metallic silver in filament form (average length 0.09 $\mu$m) with a silver content of 0.44 mg/dm$^2$.

The dust and debris were then evaluated as described in Example 1.

The results are given in Table 1 below.

EXAMPLE 3

Invention

In this example, the same operating method was reproduced using the copy positive film from Example 2 into which was introduced an interlayer between the additional layer containing metallic silver in filament form and the emulsion layer with green sensitive silver halides containing a magenta dye-forming coupler, this interlayer containing 0.85 mg/dm$^2$ of 2,5-di-sec-dodecylhydroquinone.

The dust and debris were then evaluated as described in Example 1.

The results are given in Table 1 below.

EXAMPLE 4

Comparison

In this example, the operating method of Example 1 was reproduced going from copy positive film to the ECP® film, as previously described, but comprising an additional layer located between the protective layer and the set of sensitive layers, this layer comprising gelatin (9.15 mg/dm$^2$) and a Lippman emulsion constituted of silver bromide grains having an average size in the order of 0.05 $\mu$m (Ag content: 0.44 mg/dm$^2$)

The dust and debris were then evaluated as described in Example 1.

The results are given in Table 1 below.

EXAMPLE 5

Comparison

In this example, the operating method of Example 1 was reproduced going from copy positive film to the ECP(® film, as previously described, but comprising in the protective layer of metallic silver in filament form (average filament length: 0.09 $\mu$m) with a silver content in the order of 0.44 mg/dm$^2$.

The dust and debris were then evaluated as described in Example 1.

The results are given in Table 1 below.

TABLE 1

| | Ex. 1 | Ex. 2 | Ex. 3 | Ex. 4 | Ex. 5 |
|---|---|---|---|---|---|
| Dust count | 30 | 10 | 17 | 31 | 30 |

These results clearly show that the amount of dust and debris is strongly reduced when the photographic product contains, between the protection layer and the set of sensitive layers, a layer containing metallic silver.

The invention has been described in detail with particular reference to certain preferred embodiments thereof, but it will be understood that variations and modifications can be effected within the spirit and scope of the invention.

What is claimed is:

1. A photographic material comprising a support coated with a set of silver halide image-forming emulsion layers, a non image-forming layer, and a hydrophilic colloid protective layer wherein the non image-forming layer is situated between the protective layer and the set of image-forming layers and comprises metallic silver in particle form and in an amount from 0.1 to 1 mg/dm$^2$ said material further comprising a layer containing an oxidized developer scavenger located between the non image-forming layer and the set of image-forming layers.

2. The material according to claim 1 wherein the set of image-forming silver halide emulsion layers contains, in order from the support, an emulsion layer with blue sensitive silver halides containing a yellow dye-forming coupler, an emulsion layer with red sensitive silver halides containing a cyan dye-forming coupler, and an emulsion layer with green sensitive silver halides containing a magenta dye-forming coupler.

3. The material according to claim 1 wherein the metallic silver is in filament form.

4. A process for printing motion picture copies which comprises exposing through a color negative film, a photographic material comprising a support coated with a set of silver halide image-forming emulsion layers, a non image-forming layer, and a hydrophilic colloid protective layer wherein the non image-forming layer is situated between the protective layer and the set of image-forming layers and comprises metallic silver in particle form.

* * * * *